US006827654B2

(12) United States Patent
Meyer

(10) Patent No.: US 6,827,654 B2
(45) Date of Patent: Dec. 7, 2004

(54) DEVICE FOR TRAINING A SEQUENCE OF MOVEMENTS

(76) Inventor: Ingo Meyer, Sonnenbergstr. 11, 74343 Ochsenbach (DE)

( * ) Notice: Subject to any disclaimer, the term of this patent is extended or adjusted under 35 U.S.C. 154(b) by 0 days.

(21) Appl. No.: 10/312,251

(22) PCT Filed: Jun. 20, 2001

(86) PCT No.: PCT/EP01/06942

§ 371 (c)(1),
(2), (4) Date: May 23, 2003

(87) PCT Pub. No.: WO02/00311

PCT Pub. Date: Jan. 3, 2002

(65) Prior Publication Data

US 2003/0178773 A1 Sep. 25, 2003

(30) Foreign Application Priority Data

Jun. 24, 2000 (DE) ..... 100 30 961

(51) Int. Cl.[7] ..... A63B 69/36

(52) U.S. Cl. ..... 473/212; 473/207; 473/229; 473/553; 24/300; 24/303

(58) Field of Search ..... 24/300, 303; 473/212, 473/215, 217, 19, 223, 224, 226, 227, 229, 231, 234, 238, 266, 269, 276, 251, 233, 216, 458, 464, 450, 207, 208; 273/451; 446/251; 482/124, 129, 110, 122

(56) References Cited

U.S. PATENT DOCUMENTS 3,063,118 A * 11/1962 Salter et al. ..... 24/303
3,339,926 A 9/1967 Coupar
3,858,881 A * 1/1975 Hurwitz ..... 473/553
3,861,688 A 1/1975 Butler
4,239,228 A * 12/1980 Norman et al. ..... 473/212
4,357,717 A * 11/1982 Puhl ..... 623/65
4,377,284 A * 3/1983 Okerlin ..... 473/450
4,587,956 A * 5/1986 Griffin et al. ..... 600/15
4,661,113 A * 4/1987 Adkins ..... 623/65
5,016,885 A * 5/1991 Quigley ..... 473/217
5,108,103 A 4/1992 Rilling
5,150,901 A 9/1992 Stawicki
5,174,575 A * 12/1992 Leith et al. ..... 473/213
5,782,743 A * 7/1998 Russell ..... 600/9
6,434,801 B2 * 8/2002 Grunberger ..... 24/303
6,447,402 B2 * 9/2002 Moran ..... 473/226

FOREIGN PATENT DOCUMENTS

GB 988796 4/1965
GB 2336787 11/1999

* cited by examiner

*Primary Examiner*—Gregory Vidovich
*Assistant Examiner*—Nini F. Legesse
(74) *Attorney, Agent, or Firm*—Roylance, Abrams, Berdo & Goodman L.L.P.

(57) ABSTRACT

A device (10) for training a sequence of movements for ball hitting implements (18), especially golf clubs and baseball bats, permits monitoring the observance of the correct sequence of movements. The monitoring device acts upon the implement (18) and the user. The device permits the individual user to be in a position to check whether a sequence of movement is being correctly performed, while he or she is executing the sequence of movements and to correct it if necessary.

17 Claims, 6 Drawing Sheets

DEVICE FOR TRAINING A SEQUENCE OF MOVEMENTS

FIELD OF THE INVENTION

The present invention relates to a device for training a sequence of movements for ball-hitting implements, especially golf clubs or baseball bats.

BACKGROUND OF THE INVENTION

In sports in which ball-hitting implements are used, for example golf, generally a complex sequence of movements will be encountered in using these implements. Learning, practicing and monitoring these sequences of movements poses problems for beginners. By incorrect execution of the corresponding movements and inadequate correction of these errors, rapid progress and the associated sense of achievement remain elusive for beginners. Even in players who play these sports professionally, the pertinent monitoring of sequences of movements is regarded as an indispensable prerequisite for good play.

In the past, for checking the sequence of his movements, a player had to enlist another individual to watch and correct him, or to use complex video technology allowing him to examine the execution of his movements subsequently. These measures, whether time with a coach or use of video cameras, is expensive for the player and, if at all, is not always available to him at the desired time. It is furthermore disadvantageous, that when subsequently viewing the recorded video material, the respective player does not have the opportunity to directly correct errors in the sequence of his movements and in particular he does not receive any feedback (biofeedback) about his errors.

U.S. Pat. No. 5,150,901 discloses a golf training device which can be fixed to the upper body of the user by a chest harness. The device itself has two telescoping sleeve parts which are held to be able to travel lengthwise into one another. One telescoping part engages the chest harness. The other telescoping part engages the grip of the golf club. As a result of the rigid arrangement of these telescoping parts which can travel lengthwise into one another and as a result of fixing the training device by the indicated chest harness, the golf-playing user is also greatly hampered in his play during training so that the approach is less feasible for practical applications.

U.S. Pat. Nos. 3,861,688 and 5,108,103 disclose golf training devices with acoustic feedback. The training device is attached especially to the wrist of the golfer and to the golf club itself in the vicinity of the grip. An elastic resettable connecting part between the wrist and the golf club monitors the centrifugal force situation during the sequence of movements. When the sequence is not ideal, the golfer receives a corresponding error or correction report via an acoustic signal. Since with these devices essentially only correct monitoring of the hand position during the course of the stroke, mispositioning of other body parts, especially with regard to arm posture during the golf stroke, remains ignored. Accordingly, these known devices do not ensure that the entire sequence of movements during the golf swing is practiced correctly to master the entire sequence of movements in this way.

GB-A-988 796 and GB-A-2 336 787 disclose establishing a connection between a golf glove or the club grip and the shoulder or the upper arm of a golfer of bands and loops. The bands and loops are designed to capture the centrifugal forces during the swing and deliver feedback about the correct sequence of movements to the user. In the golf training device of GB-A-2 336 787, only one-hand training motion is possible, with the other hand being kept stationary by the user on the upper body. The training device touches the shoulder of GB-A-988 796. By a resettable force means, another band is placed under the opposite shoulder of the other arm of the user. During the stroke motion, the shoulder band cannot unintentionally slip down. With the known training device, the user can carry a golf bag or the like supported by the shoulders of the user. In particular, this mitigates tiresome carrying on longer golf courses. The training effect with these known devices is likewise rather small. If only one hand or one arm is correctly trained for a sequence of movements, this training does not apply to the sequence of movements with the two stroking hands of a user, as experience indicates.

U.S. Pat. No. 3,339,926 discloses a golf training device which engages between the wrist and the upper arm of the user. Fixing possibilities in this regard are closing bands between which extend two telescoping sleeve parts. The parts fit into one another with a lengthwise travel capacity on their facing ends. The telescoping part facing the wrist has a slotted guide. The other telescoping part on its outside periphery has a fixing aid with a movable chain. This arrangement permits monitoring the bending motion of the arms during the stroke such that overbending cannot occur. An unintentional motion is intercepted by the chain of one telescoping part which then fits into the slotted part of the other telescoping part in an obstructing manner. A certain pattern of movement can only be partially monitored, specifically any overbending of the arm posture during the sequence of movements so that the entire sequence of movements during a golf swing cannot be properly monitored and trained in this way.

SUMMARY OF THE INVENTION

Objects of the present invention are to provide a player with a simple and economical aid for directly noting and correcting errors in the sequence of his movements when hitting the ball, without being reliant on the assistance of third parties or on complex video recording technology.

The foregoing objects are basically obtained by monitoring means having at least two component parts detachable from one another and interactable with one another by a force means. In this manner, at least at the start and end of the sequence of movements, the detachment of the component parts is obstructed or their joining takes place in an accelerated manner. The force means opposes the centrifugal force during the swinging motion with the ball-hitting implement. Both the detachment of the component parts and the later joining deliver an acoustic signal to the user to reliably indicate to him at least the start and end of the sequence of movements. At least in the preparation of the hitting phase in which the ball-hitting implement hits the ball, for a correctly maintained sequence of movements, the centrifugal forces are so great that a visible and perceptible separation of the component parts takes place after passing through the obstruction. The separation provides the user, in the sense of biofeedback or feedback, with a monitoring possibility for correctly passing through the desired movement. Especially in the critical transition area between the actual starting phase of the stroke and the later hitting phase, the monitoring means is in action and delivers the required feedback for the desired correct sequence of movements.

The device of the present invention is fixed on the one hand on the hitting implement, preferably in the area of the transition between the other part of the implement and the grip of the implement, and on the other on the upper arm of the user, preferably in the area above the elbow joint, for righthanders the upper left arm, and for lefthanders preferably the upper right arm. While carrying out the actual swinging motion for producing the ball-hitting force, the centrifugal forces, occurring in the system of the implement, the user and the device, are used to trigger the monitoring means. Depending on its respective system state, the monitoring means relays feedback to the user who evaluates the pertinent feedback to learn the correct sequence of movements with the ball-hitting implement.

In one preferred embodiment of the device of the present invention, the monitoring means has at least two component parts which can be detached from one another and which interact with one another by a force means. At least at the start and end of the sequence of movements, the detachment of the component parts is obstructed or their joining takes place in an accelerated manner. The force means consequently opposes the centrifugal force. Both the detachment of the component parts and the later joining deliver an acoustic signal to the user to reliably indicate to him at least the start and end of the sequence of movements. At least in the preparation of the hitting phase in which the ball-hitting implement meets the ball, for a correctly maintained sequence of movements the centrifugal forces are so great that a visible and perceptible separation of the component parts takes place after passing through the obstruction to provide the user, in the sense of biofeedback or feedback, with a monitoring possibility for correctly passing through the desired sequence of movements. Especially in the critical transition area between the actual starting phase of the stroke and the later hitting phase, the monitoring means is effective and delivers the required feedback for the desired correct sequence of movements.

In one especially preferred embodiment of the device of the present invention, the force applied by the force means tries to keep the component parts permanently in contact with one another. The amount of force can be preset by an adjustment means. The adjustment means makes it possible, within definable limits, to adapt the device to the biophysical circumstances of the respective user so that the device can be used for children, adolescents and adults, even without major changes of a structural type.

In another especially preferred embodiment of the device of the present invention, the component parts in each of their positions relative to one another are joined to one another by a connecting means. As part of the force means, the connecting means applies a reset force to the component parts. In this way, in the area of the end phase or the so-called finish in which the hitting phase ends after hitting the ball, the monitoring means will again assume its original system state in which the component parts adjoin one another to obstruct the travel through a following sequence of movements again. The indicated reset force in the so-called finish range causes the two component parts of the monitoring means to be audibly brought together to notify the user acoustically of the end of the swinging motion. The device is then available to the user to be used again.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

The device of the present invention shown in the figures is to be used especially for golf clubs. This device can also be used for other types of ball-hitting implements, for example for baseball bats and tennis rackets.

The views of FIGS. 1*a* to *d* are in the nature of snapshots showing the execution of a ball-hitting movement with a device 10 according to the present invention. The device 10 has its two ends 12 and 14 is fixed on a body part in the form of the upper arm 16 of the user and on the club 18, respectively. The sequence of movements shown in FIGS. 1*a* to *d* for a right-hander can, of course, also be carried out for left-handers with the corresponding requisite changes.

Figure 1B:
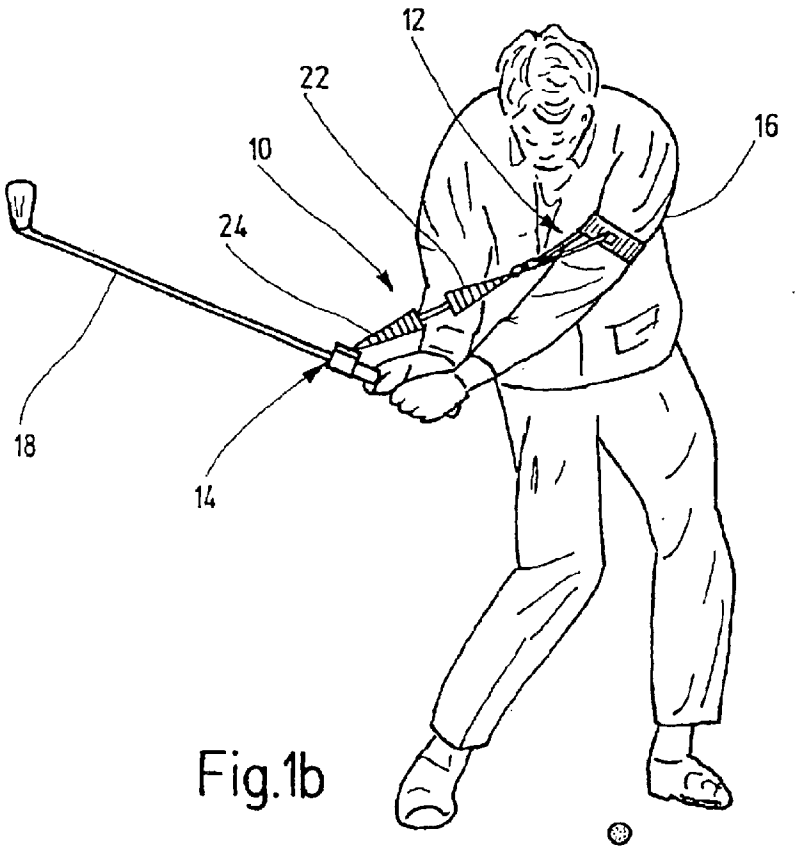
FIGS. 1*a, b, c* and *d* are frontal elevational views of the position of an individual practicing with a ball-hitting implement in the form of a golf club divided in four successive phases of movement, with a device according to an embodiment of the present invention.
Figure 1A:
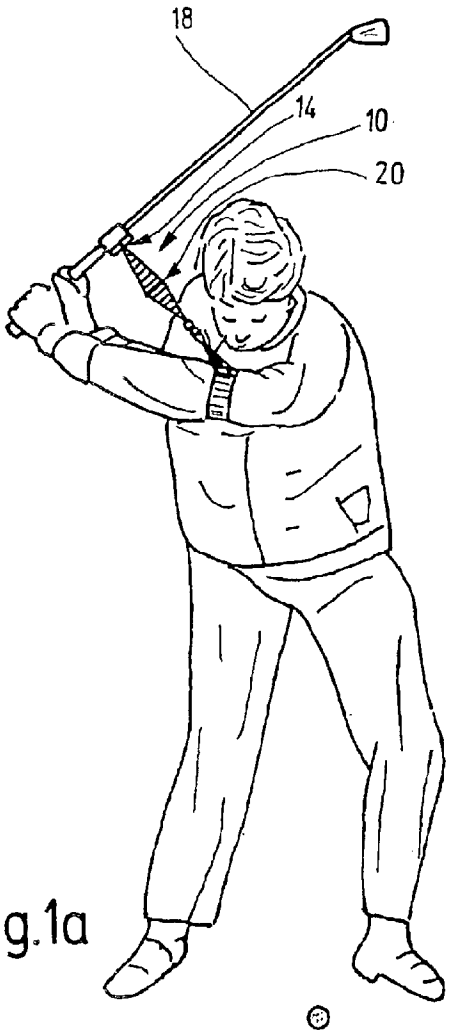

FIG. 1*a* shows the user with the club 18, after executing the drawback phase with backswing, at the start of the so-called downswing. The pivot of the club motion is in the vicinity of the shoulder of the user. In the course of the follow through, the left arm is extended when the sequence of movements is correct. The initiation of just this movement is signaled to the user by the monitoring means. The two components pieces 22, 24 moving apart with an audible metallic sound as the magnetic force acting between them is overcome.

FIG. 1*b* shows the user with the club 18 during a superimposed second rotary motion, when within the follow through movement the hands of the user are roughly at hip height. In this rotary motion, the club 10 is moved around a pivot in the wrists of the user. The sequence of movements in this respect corresponds to what is shown in FIG. 1*c*.

Figure 1D:
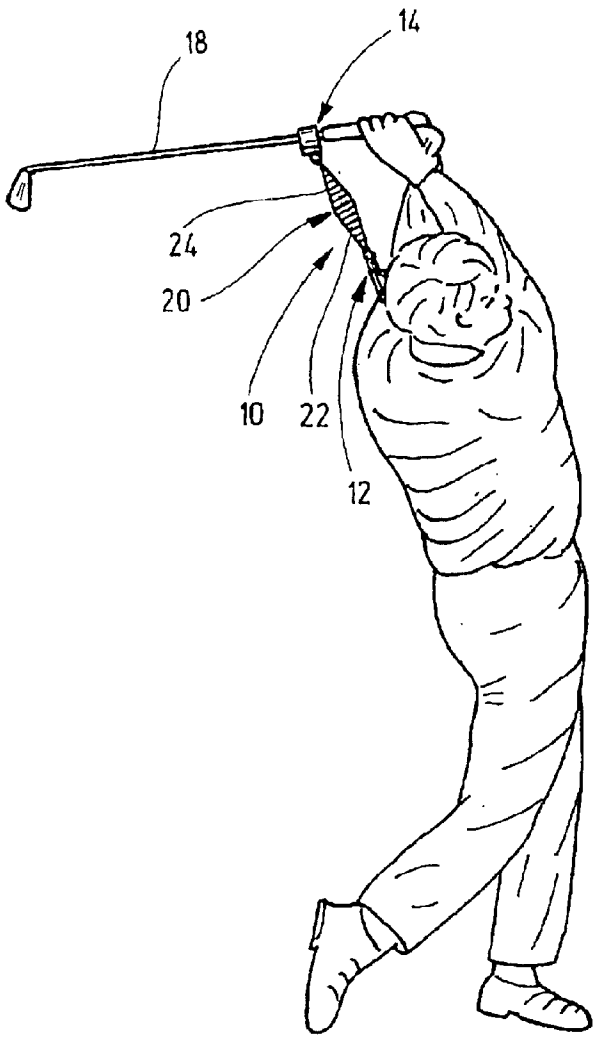
Figure 1C:
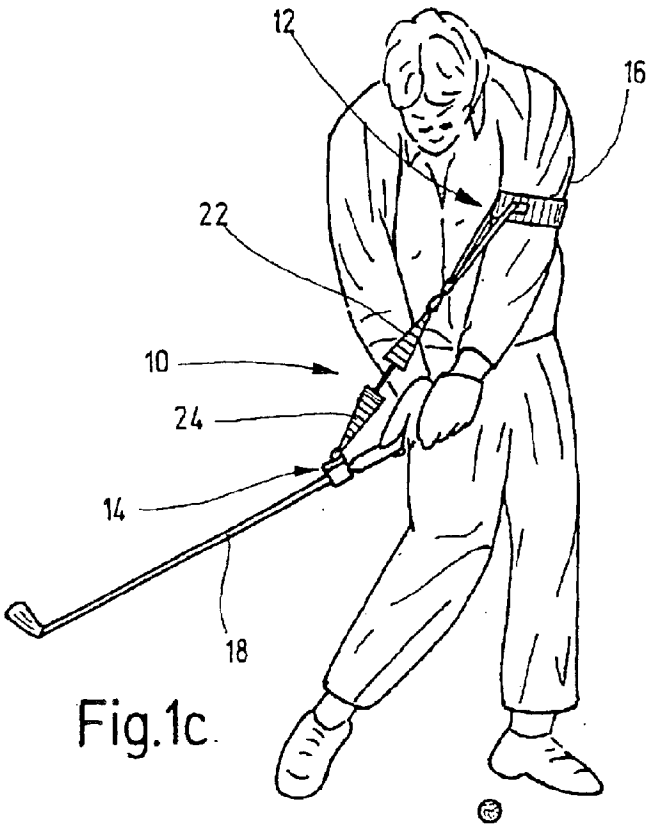

The component parts 22, 24 are joined by a connecting means 26 applying a reset force to the component parts 22, 24, as shown in FIG. 1*d*, after the user has hit the ball and followed through with the club in sequence in front of the body. The component parts are again brought together in the so-called finish (end phase). The two component parts 22, 24 being brought together is again linked to a perceptible metallic clicking as an acoustic signal as soon as they make contact with one another.

The above-described sequence of movements basically has a model-like nature in order to illustrate the fundamental relationships. Especially in professional sports, there are conventionally deviations from the described sequence of movements. However, this deviation is immaterial for the use of the training device controlled by centrifugal force, as in the present invention.

Figure 2:
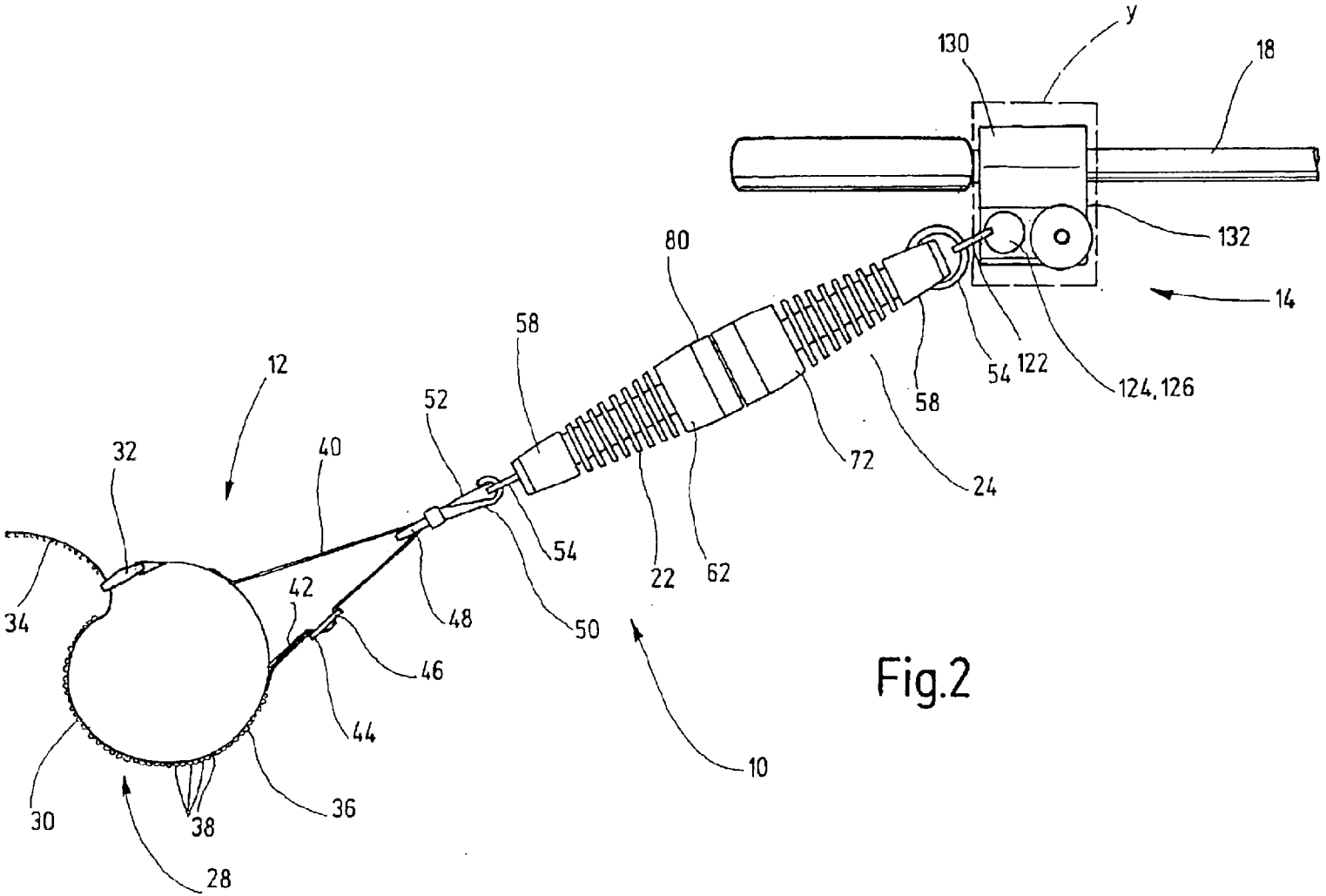
FIG. 2 is an enlarged, side elevational view of the device of FIG. 1, affixed to a golf club with a monitoring means.

FIG. 2 shows the device 10 in its entirety fixed on the golf club 18 (shown only partially). Proceeding from the first end 12, which is fixed on the upper arm of the user, a fixing means 28 in the form of an adhesive fastener band 30 with a rectangular eye 32 of plastic material is attached to its one end. The free end 34 of the adhesive fastener band 30 is inserted through eye 32 and returns after encompassing the upper arm. Then, free end 34 is pulled back so that the adhesive fastener means 38, attached to the outside periphery 36 of the adhesive fastener band 30, engage to the free end 34. The ends of a cloth strip 40, forming a loop, are attached to the outside periphery 36 of the adhesive fastener band 30. A metal eye 44 is attached to another loop 42 of the cloth strip. Eye 44 is used for lengthwise adjustment of the cloth strip 40. Strip 40 is inserted past a tongue-like cross brace 46 of the eye 44. This arrangement prevents the strip 40 from slipping through. This adjustment enables matching of the device to the conditions of the body of the user.

Figure 3:
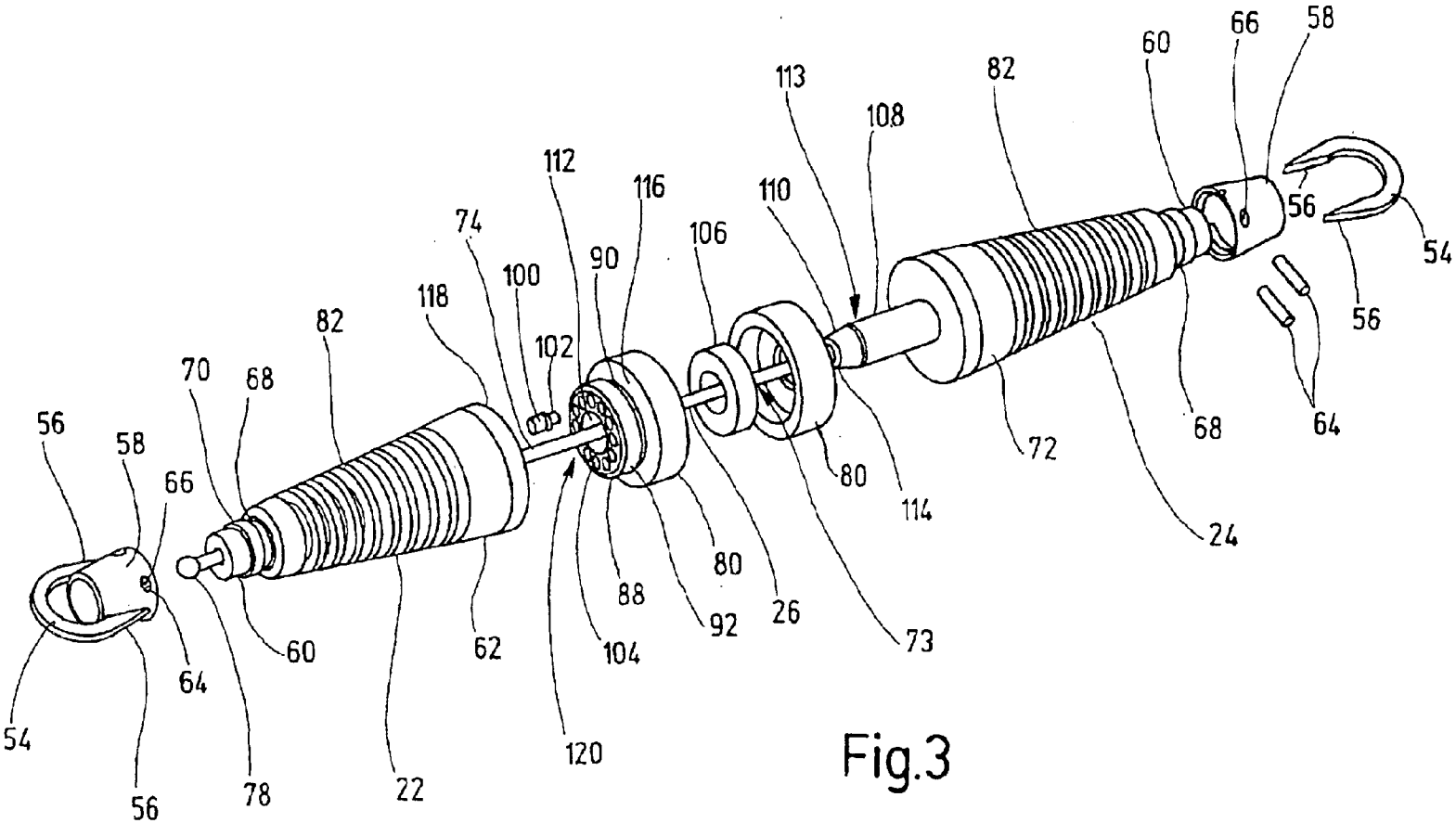
FIG. 3 is an exploded, perspective view of the parts of the monitoring means of the device of FIG. 2.

Furthermore, the cloth strip 40 passes through and pulls on a U-shaped metal holder 48. A spring hook 50 with a leaf spring closure 52 is pivotally supported on holder 48. The spring hook 50 here fits through a metal clip 54 with two open ends 56 attached to the opposing points of the outside periphery of a metal truncated hollow cone 58 (FIG. 3). The cone can be fixed, after it has been turned over the end piece 60 of the base body 62 of the component part 22 of the monitoring means 20, by two metal cotter pins 64. The cotter pins are driven opposite to one another and perpendicular to the axis of symmetry of the truncated hollow cone 58 through openings 66. On the part of the base body 62, these cotter pins 64 slide in a peripheral groove 68, which is especially apparent in FIGS. 4 and 5. A peripheral or annular projection 70 prevents the truncated hollow cone 58 from being withdrawn or separated from the base body 62.

Figure 4:
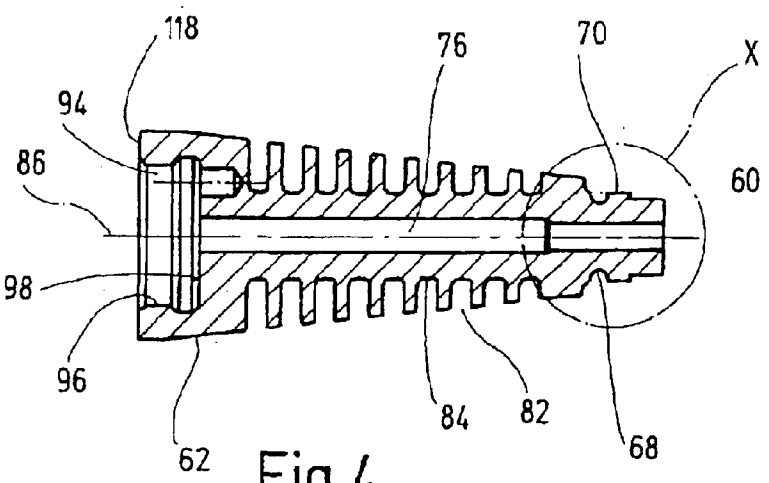
FIG. 4 is a side elevational view in section of each of the two component parts of the monitoring means of FIG. 3.
Figure 5:
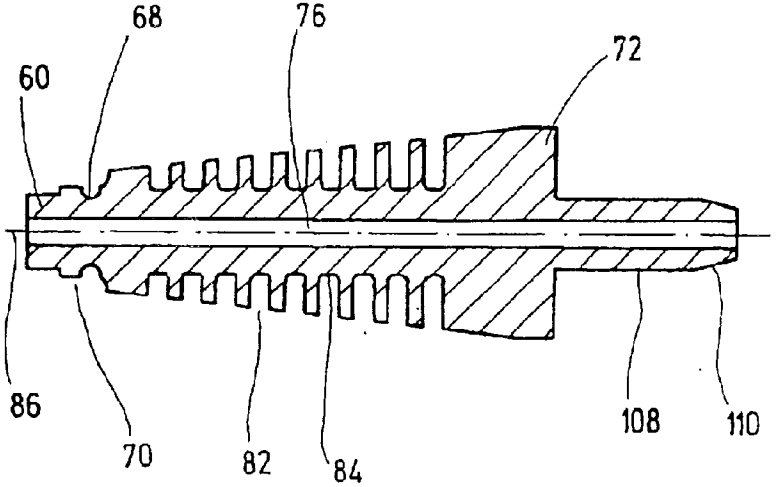
FIG. 5 is an enlarged, partial side elevational view in section of the component part portion within the circle designated "X" in FIG. 4.
Figure 5:
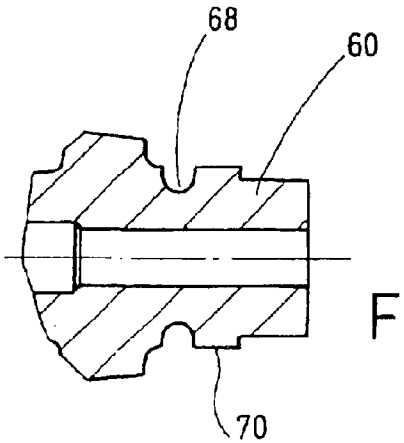

The two component parts 22 and 24, with base bodies 62 and 72 are shown in FIGS. 3 and 4, and are joined to one another by the connecting means 26 as part of a force means which is designated 73 as a whole. The force means includes an elastic cord 74 guided or extended through the cylindrical recesses 76 of the component parts 22, 24. The recesses are located along the lengthwise axis of the component parts. The elastic cord is attached by fixing means 78. A metal ring 80 is on one piece of the same cross section of the base bodies 62, 72. Each base body is formed of laminated plastic, and has a cross section which tapers in the direction to its outer end. In the area of the tapering cross sections, the base bodies 62, 72, recesses 82 are spaced uniformly over the periphery. The recess bottoms 84 are each spaced the same distance from the lengthwise axes 86 of the component parts. A rib structure is thereby formed which extends into the solid end pieces 60. The rib structure yields a weight reduction which facilitates handling for the conical component parts 22, 24.

For the component part 22, the assigned metal ring 80 on its side facing the base body 62 has an end piece 88 with a tapering cross section, as can also be seen in FIG. 3. An outside thread 92 is provided on the outside periphery 90 of this tapered cross section, and is used for screwing to an inside thread 96 provided in the cylindrical recess 94 in the base body 62. A thrust piece 100 is embedded, spring-loaded in the bottom 98 of the recess. When the base body 62 is screwed with the assigned metal ring 80, hemispherical head 102 of thrust piece 100 fits into the conical recesses 104. Recesses 104 are provided on the side of the tapered cross section of the metal ring 80, which side faces the bottom 98 of the recess. These recesses are located diametrically relative to the lengthwise axis 86 of the component parts by an angular amount which is the same in each case.

A ring magnet 106 is another primary part of the force means 73, has the same cylinder axis, and is countersunk into the metal ring 80 attached to the base body 72 and assigned to the component part 24. Ring magnet 106 applies an attractive force to the other metal ring 80 assigned to the component part 22. On the component part 24, a cylindrical plastic piece 108 projects in the direction of the other component part 22 out of the base body 72 along the lengthwise axis 86 of the component parts. Cylindrical piece 108 has a conical end piece 110, which together with a recess 112, provide a guide means 113, and is partially surrounded peripherally by the metal ring 80 and the magnet 106. The part of the plastic piece 108 projecting beyond the metal ring 80 with the magnet 106 along the lengthwise axis 86 of the component part, when the component parts 22 and 24 are brought together, then grips the cylindrical recess 112 of the other or second metal ring 80 assigned to the component part 22. As part of the force means 73 with the first metal ring 80, that part interacts with the ring magnet 106. Recess 112 runs along the lengthwise axis 86 of the component part. The ring surface 114 of the conical end piece 110, which surface faces the component part 22, in this type of passage is in contact with the bottom 98 of the cylindrical recess 94 in the base body 62 before the outside thread 92 of the metal ring 80 engages the inside thread 96 of the base body 62. In this manner, ring surface 114 and bottom 98 adjoin one another flat with the facing ring surfaces 116, 118 of the metal ring 80 or of the base body 62. In a further screwing-in process in which the two threads 92, 96 are moved by twisting the base body 62 against the assigned metal ring 80. The second base body 72 is supported on the first base body 62. The two component parts 22, 24 are located against one another, spaced apart. The thrust piece 100 projects out of the recess bottom 98 into the respectively assigned conical recess 104. In the manner of a ratchet, definable adjustment of the magnetic force holding the two component parts 22, 24 together is possible. The ratchet approach results in that the magnetic force, once set, does not change unintentionally during operation of the device 10. In this way, it could adversely affect the operation of the device 10. The device 10 can be matched to the special user conditions, especially with respect to body sizes and body forces present at the time, by way of the described magnetic force adjustment means 120.

Figure 6:
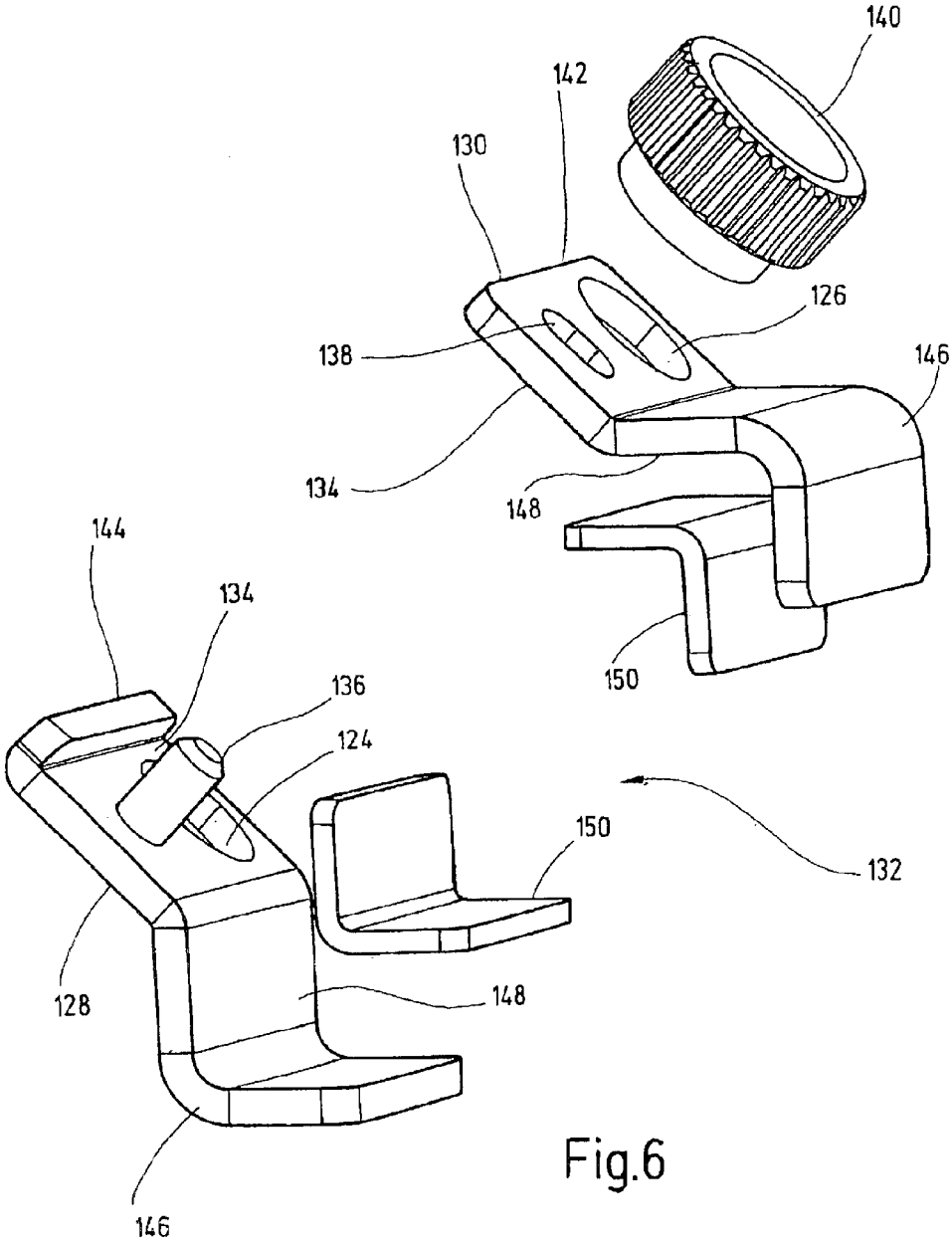
FIG. 6 is an enlarged exploded, perspective view of the fixing clamp within box "Y" in FIG. 2.

The end 14 of the component part 24 facing the club 18 likewise has, as in the component part 22, a truncated hollow cone 58. Cone 58 is guided on the end piece 60 by metal cotter pins 64 sliding in a peripheral groove 68, with a metal clip 54 fixed on it. A steel ring 122 extends through metal clip 54 and extends through round openings 124, 126 on two clamp sheets 128, 130 of a fixing clamp 132, as is shown in FIG. 6. This fixing clamp 132 is used to fix the device 10 on the club 18. For this purpose, the two clamp sheets 128 and 130, with their inner base surfaces 134, are placed on one another. A cylindrical screw piece 136 projects vertically from the inner base surface 134 of the first clamp sheet 128, and extends with the thread through another recess 138 of the second clamp sheet 130 so that the two clamp sheets 128, 130 can be detachably secured on one another using a lock nut 140, as the circular openings 124, 126 lie on top of one another. The side surface 142 of the clamp sheet 130 adjoins the projection 144 which projects over the side surface of the clamp sheet 128 to additionally prevent the two clamp sheets 128, 130 from sliding off one another. On the side of the clamp sheets 128, 130 facing the club 18 they are provided with equal-sided angle pieces 146. The angle pieces project at an angle of 45° from the clamp sheets. Each angle piece includes an angle of 90° such that, when the clamp sheets 128, 130 lie on one another, the angle pieces enclose a cavity with a square base surface to hold a piece of the club 18. To prevent damage or stick on the club 18, the angle pieces 146 have rubber cushions 150 which cover their entire inner surfaces 148.

For purposes of illustration, the manner of action of the device 10 from FIGS. 2 and 3 during the various phases of the sequence of movements shown in FIGS. 1*a* to 1*d* is discussed. A device 10 is fixed on the club 18 and on the upper arm 16 of a right-handed user, adapted by means of the ratchet approach to his physical conditions. In the ratchet approach, the component parts 22, 24 are spaced apart from one another in definable increments by the adjustment means 120. Twisting of the base body 62 of the component part 22 against the metal ring 80, which is assigned to it, causes a change of the distance between the metal rings 80. The associated change of the force which acts between the component parts 22, 24 allows the user to adapt to his individual circumstances.

In FIG. 1*a* this user is in the initial phase of the sequence of movements and after the drawback motion with the club 18 executes a first type of lever motion of his arm around the left shoulder area, during which the monitoring means 20 is not triggered.

In FIG. 1*b* the user, with his hands roughly at hip height, in the sequence of his movements reaches the hitting phase in which the first type of lever motion is superimposed by a second type during which the club 18 is moved around the wrists of the user. The centrifugal motion triggers the monitoring means 20, which is now tensioned tautly between the upper arm of the user and the club 18. If the amount of force which engages the monitoring mean 20 exceeds the magnetic force which obstructs loosening of the component parts 22, 24, as for example in the transition from the position which is shown in FIG. 1*a* into the position which is shown in FIG. 1*b*, the component parts 22, 24 are separated from one another in a clearly audible manner. FIG. 1*c* shows the user still in the hitting phase of the sequence of movements with the now separated component parts of the monitoring means 20 which is attached to the club 18. Furthermore, FIGS. 1*b* and 1*c* illustrate that separation of the component parts 22, 24 takes place in the visual field of the user; his exercise of monitoring is improved in addition using this optical signal.

After hitting the ball in the end phase of the sequence of movements, the club 18 is swung forward first in front of the body of the user and then, as shown in FIG. 1*d*, is guided on the left side to behind the body. By mobilization of the reduction of the centrifugal force, the component parts 22, 24, which are joined to one another during the entire sequence of movements regardless of their relative position to one another by a connecting means 26 in the form of an elastic, extended connecting element, especially an elastic cord 74, are again caused to approach one another. By the plastic piece 108 with the conical end piece 110 fitting into the recess 112, the guide means 113 provides for the two component parts 22, 24 being brought together again such that in their initial position they are located along a common lengthwise axis. After the component parts 22, 24 are brought visually and audibly together, the device 10 is immediately available again for execution of the sequence of movements.

The above described sequence of movements is of a purely model nature for a more detailed explanation of the invention. Depending on the individual circumstances, it is also possible to deviate from this model without adversely affecting the functionality of the device as claimed in the invention.

While one embodiment has been chosen to illustrate the invention, it will be understood by those skilled in the art that various changes and modifications can be made therein without departing from the scope of the invention as defined in the appended claims.

What is claimed is:

1. A monitoring device for training a correct sequence of movements for ball-hitting implements, comprising:

first and second component parts;

a detachable connection between adjacent axial ends of said first and second component parts;

a force means connecting said component parts for relative axial movement therebetween and axially biasing said component parts toward one another;

a fixing mechanism, coupled to said first component part, for attaching said first component part to single upper arm of a user at a fixed distance; and a clamp, coupled to said second component part, for securing a ball hitting implement to said second component part at a fixed distance;

whereby maintenance of the correct sequence of user movements with the implement can be monitored by joining and separating of said first and second component parts with and against biasing of said force means, respectively.

2. A monitoring device according to claim 1 wherein said first and second component parts transmit at least one of an acoustic signal and an optical signal to the user during monitoring of the sequence of movements with the implement; and the sequence of movements is divisible unto into at least an initial phase, a hitting phase and an end phase.

3. A monitoring device according to claim 2 wherein the first and second component parts indicate a start and an end of the hitting phase by an acoustic signal, and permit monitoring by an optical signal during the sequence of movements.

4. A monitoring device according to claim 1 wherein said forces means always biases said first and second component parts toward engagement with one another; and adjustment means, coupled to said component parts, varies a preset biasing force of said force means.

5. A monitoring device according to claim 1 wherein said force means comprises at least one magnet coupled to at least one of said component parts.

6. A monitoring device according to claim 5 wherein adjustment means, coupled to said components varies a preset biasing force of said magnet by varying relative spacing of said first and second component parts.

7. A monitoring device according to claim 1 wherein a connecting means joins said first and second component parts in all relative positions thereof, and is part of said force means in biasing said component parts toward one another.

8. A monitoring device according to claim 7 wherein guide means, coupled to said component parts, maintain axial alignment of said component parts.

9. A monitoring device according to claim 1 wherein said first and second component parts are relatively rigid.

10. A monitoring device according to claim 1 wherein said fixing mechanism and said clamp are rotatably coupled to opposite axial ends of said first and second component parts, respectively.

11. A monitoring device according to claim 1 wherein first and second rings are attached to said adjacent axial ends of said first and second component parts, respectively.

12. A monitoring device according to claim 11 wherein said rings are formed of metal.

13. A monitoring device according to claim 1 wherein said force means comprising an elastic cord extending through and between said component parts.

14. A monitoring device according to claim 1 wherein first and second metal rings are attached to adjacent ends of said first and second component parts, respectively; and said first and second component parts comprise first and second base bodies, respectively, said second base body having a connecting piece extending through said rings and abutting said first base body to define a minimum separation between said base bodies.

15. A monitoring device according to claim 14 wherein a magnet is mounted in said second metal ring.

16. A monitoring device according to claim 15 wherein said first metal ring is adjustably coupled to said first base body to vary spacing between said first metal ring and said magnet when said component parts are joined.

17. A monitoring device according to claim 1 wherein said component parts are tapered in directions away from said adjacent axial ends.

* * * * *